US010184461B2

(12) United States Patent
Adams

(10) Patent No.: US 10,184,461 B2
(45) Date of Patent: Jan. 22, 2019

(54) PUMP DEVICE AND METHOD THEREFOR OF CONVEYING FLUID, AND METHOD OF MANUFACTURING THE PUMP DEVICE

(71) Applicant: SMITHS MEDICAL ASD, INC., Plymouth, MN (US)

(72) Inventor: Grant Adams, Coon Rapids, MN (US)

(73) Assignee: SMITHS MEDICAL ASD, INC., Plymouth, MN (US)

( * ) Notice: Subject to any disclaimer, the term of this patent is extended or adjusted under 35 U.S.C. 154(b) by 506 days.

(21) Appl. No.: 14/915,927

(22) PCT Filed: Sep. 15, 2014

(86) PCT No.: PCT/US2014/055636
§ 371 (c)(1),
(2) Date: Mar. 2, 2016

(87) PCT Pub. No.: WO2015/041980
PCT Pub. Date: Mar. 26, 2015

(65) Prior Publication Data

US 2016/0195075 A1 Jul. 7, 2016

Related U.S. Application Data

(60) Provisional application No. 61/879,260, filed on Sep. 18, 2013.

(51) Int. Cl.
*F04B 1/12* (2006.01)
*F04B 9/04* (2006.01)
(Continued)

(52) U.S. Cl.
CPC ..... *F04B 9/047* (2013.01); *F04B 1/124* (2013.01); *F04B 13/00* (2013.01);
(Continued)

(58) Field of Classification Search
CPC ..... A61M 5/142; F04B 1/124; F04B 9/047; F04B 13/00; F04B 39/0005; F04B 53/14;
(Continued)

(56) References Cited

U.S. PATENT DOCUMENTS 1,223,122 A 4/1917 Subry
1,513,302 A * 10/1924 Wahlstrom ..... F04B 3/00 417/257

(Continued)

FOREIGN PATENT DOCUMENTS

EP 0336112 10/1989
EP 0707148 4/1996

(Continued)

OTHER PUBLICATIONS

International Search Report re PCT/US14/055636, ISA/KR, dated Dec. 10, 2014.

(Continued)

*Primary Examiner* — Logan Kraft
(74) *Attorney, Agent, or Firm* — Louis Woo

(57) ABSTRACT

A pump has a housing having at least one inlet, one outlet, and an internal track with a given configuration. A piston movably positioned inside the housing has at least one protuberance movably mated to the track. As the piston is reciprocally driven by a motor, it is guided by the movement of the protuberance along the track to move bidirectionally along the housing and selectively rotate such that when the piston is moved to a first position, a fluid path is established through the inlet to enable fluid to be input into the housing. When the piston is moved to a second position, another fluid path is established through the outlet so that fluid is output from the housing. Multiple chambers may be formed in the housing to enable synchronous and selective opening and closing of respective inlets and outlets to enhance fluid flow.

20 Claims, 14 Drawing Sheets

(51) Int. Cl.

| | |
|---|---|
| ***F04B 13/00*** | (2006.01) |
| ***F04B 39/00*** | (2006.01) |
| ***F04B 53/14*** | (2006.01) |
| ***F04B 53/16*** | (2006.01) |

(52) U.S. Cl.
CPC ..... *F04B 39/0005* (2013.01); *F04B 53/14* (2013.01); *F04B 53/162* (2013.01)

(58) Field of Classification Search
CPC ..... F04B 53/162; F04B 2201/02011; F16H 25/12; F16H 25/122
See application file for complete search history.

(56) References Cited

U.S. PATENT DOCUMENTS

| | | | |
|---|---|---|---|
| 3,098,480 | A | 7/1963 | Worthington |
| 3,168,872 | A | 2/1965 | Pinkerton |
| 4,189,065 | A | 2/1980 | Herold |
| 4,439,659 | A | 3/1984 | Shimizu |
| 4,605,396 | A | 8/1986 | Tseo |
| 4,865,591 | A | 9/1989 | Sams |
| 5,009,251 | A | 4/1991 | Hessel |
| 5,019,054 | A | 5/1991 | Weber |
| 5,312,233 | A | 5/1994 | Tanny |
| 5,485,853 | A | 1/1996 | Stubbs |
| 5,489,274 | A | 2/1996 | Cragg |
| 5,988,452 | A | 11/1999 | Anderson |
| 7,309,327 | B2 | 12/2007 | Schaer |
| 7,726,955 | B2 | 6/2010 | Ryser et al. |
| 8,043,075 | B2 | 10/2011 | Vick |
| 8,172,799 | B2 | 5/2012 | Mohiuddin |
| 8,282,366 | B2 | 10/2012 | Hilber et al. |
| 2004/0241023 | A1 | 12/2004 | Pinkerton |
| 2007/0270761 | A1 | 11/2007 | Kirchhofer |
| 2007/0270762 | A1 | 11/2007 | Kirchhofer |
| 2008/0187449 | A1 | 8/2008 | Breidenbach |
| 2008/0287887 | A1 | 11/2008 | Mack |
| 2009/0053086 | A1 | 2/2009 | Navarro |
| 2009/0123309 | A1 | 5/2009 | Hilber |
| 2009/0196775 | A1 | 8/2009 | Navarro |
| 2010/0198060 | A1 | 8/2010 | Fago |
| 2010/0241063 | A1 | 9/2010 | Straessler et al. |
| 2011/0015580 | A1 | 1/2011 | Stroup |
| 2011/0021990 | A1 | 1/2011 | Navarro |
| 2011/0206545 | A1 | 8/2011 | Junod |
| 2012/0126795 | A1 | 5/2012 | Genoud et al. |
| 2013/0017099 | A1 | 1/2013 | Genoud et al. |
| 2013/0272908 | A1 | 10/2013 | Pierre |
| 2014/0231549 | A1 | 8/2014 | Thiemer et al. |

FOREIGN PATENT DOCUMENTS

| | | | | | |
|---|---|---|---|---|---|
| JP | 2006084025 | A | * | 3/2006 | ..... F04B 9/047 |
| WO | 2011014704 | A2 | | 2/2011 | |
| WO | 2012140052 | A1 | | 10/2012 | |
| WO | 2012140056 | A1 | | 10/2012 | |
| WO | 2012140063 | A1 | | 10/2012 | |
| WO | 2012171572 | A1 | | 12/2012 | |
| WO | 2013029999 | A1 | | 3/2013 | |
| WO | 2013136802 | A1 | | 3/2013 | |

OTHER PUBLICATIONS

Supplemental European Search Report; corresponding Application No. EP 14845049, dated Jan. 30, 2017.

* cited by examiner

PUMP DEVICE AND METHOD THEREFOR OF CONVEYING FLUID, AND METHOD OF MANUFACTURING THE PUMP DEVICE

CROSS-REFERENCE TO RELATED APPLICATION

None.

FIELD OF THE INVENTION

This invention relates generally to pumps and pumping methods. More particularly, this invention relates to a novel pump, a method therefor of conveying a fluid between a fluid source and a fluid receiving device, and a process of manufacturing the pump.

BACKGROUND OF THE INVENTION

Many types of pumps are known in the art. These include, but are not limited to: elastomeric, peristaltic, syringe, reciprocating spool, and high flow rate pumps. The high flow rate pumps, often referred to as large volume delivery pumps, are used in the medical device field. For IV pumps that rely on an elastomeric member such as a tubing, the delivery accuracy of the pump may negatively impacted by external factors such as system back pressure and fluid viscosity.

It is therefore desirable to have a pump that does not suffer from back pressure and viscosity deficits that current peristaltic pumps suffer, and advantageously combines a high flow rate, good accuracy in terms of its fluid conveyance, convenience to use, and can be manufactured efficiently at a low or modest cost. In the medical field, a pump of sufficiently compact size is furthermore desirable.

SUMMARY OF THE INVENTION

In a first exemplar embodiment, the pump of the instant invention includes an elongate cylindrical housing having at least one inlet, at least one outlet, and a track with a given configuration provided at the inside circumferential wall of the housing. The pump further includes a piston movably positioned inside the housing. The piston has at least one protuberance or boss that matingly projects into the track so that the movement of the piston within the housing is guided by the track. There is also at least one longitudinal slot or channel formed along a predetermined length at the outer surface of the piston. When driven in a reciprocating manner, the track inside the housing guides the movement of the piston to selectively move bi-directionally along and rotate relative to the housing. The piston may be reciprocally driven by a motor drivingly connected thereto via a shaft attached to the piston.

As the piston is driven in one direction along the housing, the inlet at the housing is opened, as the inlet is aligned with the channel at the piston, to enable a fluid to be input into the housing; and when the piston is driven in a second, possibly opposite direction along the housing, the outlet at the housing is opened, as the outlet is aligned with the channel, to enable the fluid in the housing to output from the housing.

Thus, the combined longitudinal and rotational movement of the piston within and relative to the housing synchronously and selectively opens and closes the respective inlet and outlet at the housing, i.e., the inlet is closed when the outlet is open and the inlet is open when the outlet is closed.

In a second embodiment of the inventive pump, the housing may be formed to have one and other chambers or compartments each with its own inlet and outlet. Further, the piston movably fitted into the housing is designed to have opposing drive surfaces so that for each stroke movement of the piston, respective sets of inlet/outlet operate in synch to fill one chamber of the housing with the fluid and at the same time output the fluid, if any, previously stored in the other chamber of the housing.

The manufacturing of the housing of the pump device of the instant invention may be advantageously and efficiently achieved by coupling together two housing half portions with to be mated track portions preformed therein.

BRIEF DESCRIPTION OF THE DRAWINGS

The present invention will become apparent and the invention will best be understood with reference to the description of the instant invention taken in conjunction with the accompanying drawings in which.

DETAILED DESCRIPTION OF INVENTION

Figure 1:
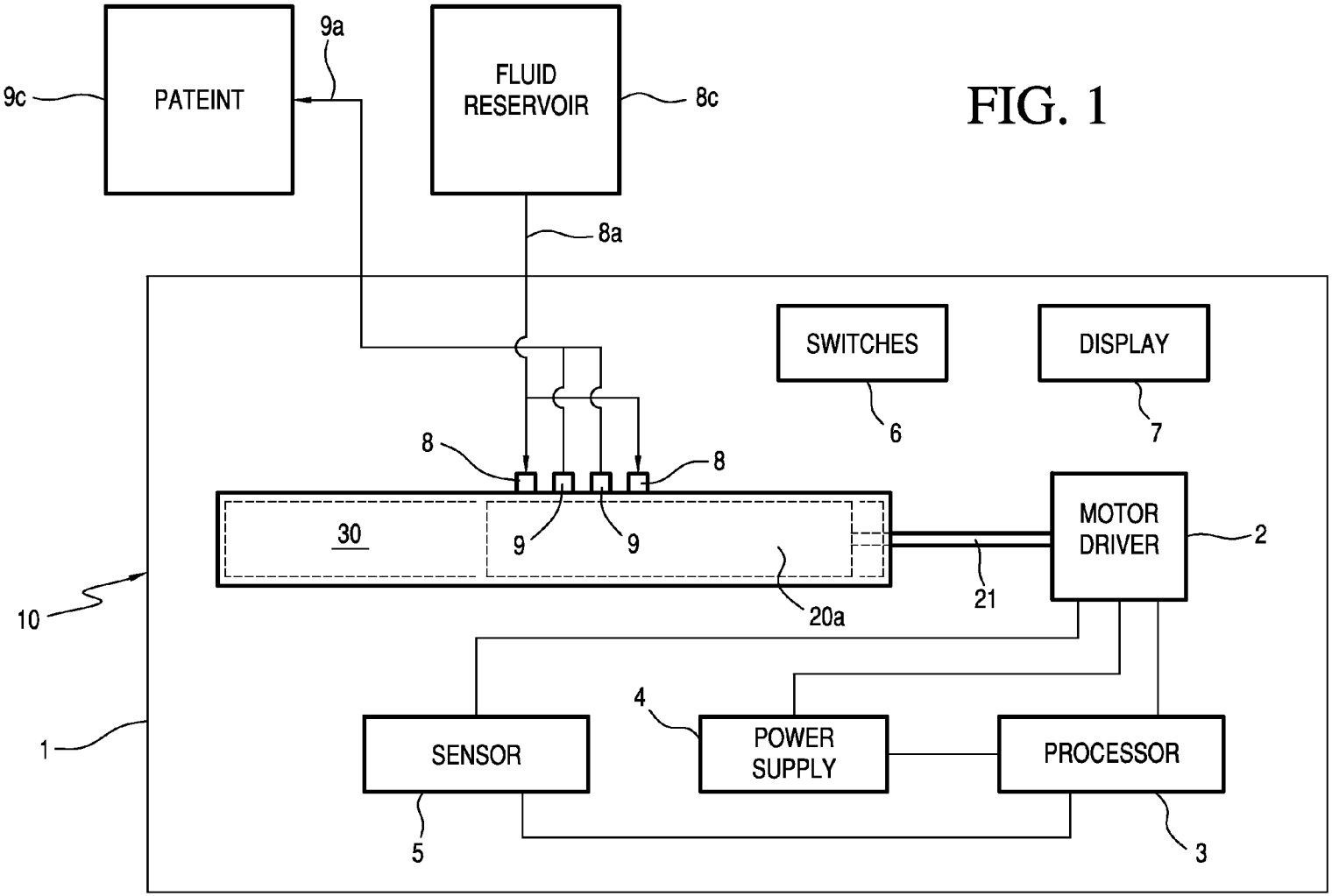
FIG. 1 is an overall view of a pump of the instant invention and the use thereof in a patient medicament delivery environment.

With reference to FIG. 1, the pump assembly 1 of the instant invention has an inventive pump 10 that includes a housing 30 and a piston 20*a* movably fitted to the housing. A drive shaft 21 connects piston 20*a* to a motorized driver 2 so that piston 20*a* is adapted to be driven bi-directionally by driver 2. Pump assembly 1 further includes a processor 3, a power supply 4 that may be battery powered or connectable directly to a power outlet as is well known, and a number of sensors 5 conventionally used to detect, among other things, the operation of driver 2, the speed with which the piston 20*a* is driven, and possible air bubbles in the fluid being pumped out to the patient. There are also provided in pump assembly 1 switches 6 for programming the operation of the pump and at least one display 7 to present information to the user as is conventionally known. The switches may not be separately provided if a touchscreen is used.

Housing 30 of pump 10 in FIG. 1 is shown to have multiple, for example two inlet ports 8 that are in fluid communication, via a bifurcated fluid line or tubing 8*a*, with a fluid store or reservoir 8*c*. Housing 30 further is shown to have multiple, for example two outlet ports 9 which have connected thereto respective bifurcated ends of a fluid line, or catheter 9*a*, which may simply be referred to as a receiving device. The other end of the catheter 9*a* may be inserted into a patient 9*c* so that a fluid path is established between the patient and the fluid store, with the intervening pump controllably conveying the fluid, or medicament, from the fluid store to the patient.

Pump 10 of the instant invention comprises three major components, namely two housing half portions and a splined piston. It should be noted that instead of being made from two halves, the housing of the pump device 10 may be manufactured as a single unitary housing, so long as the track, to be described infra, at its inner wall to guide the movement of the piston may be readily configured.

The housing of the inventive pump is described with reference to the distal and proximal housing half portions shown in FIGS. 2 and 3, respectively.

Figure 2:
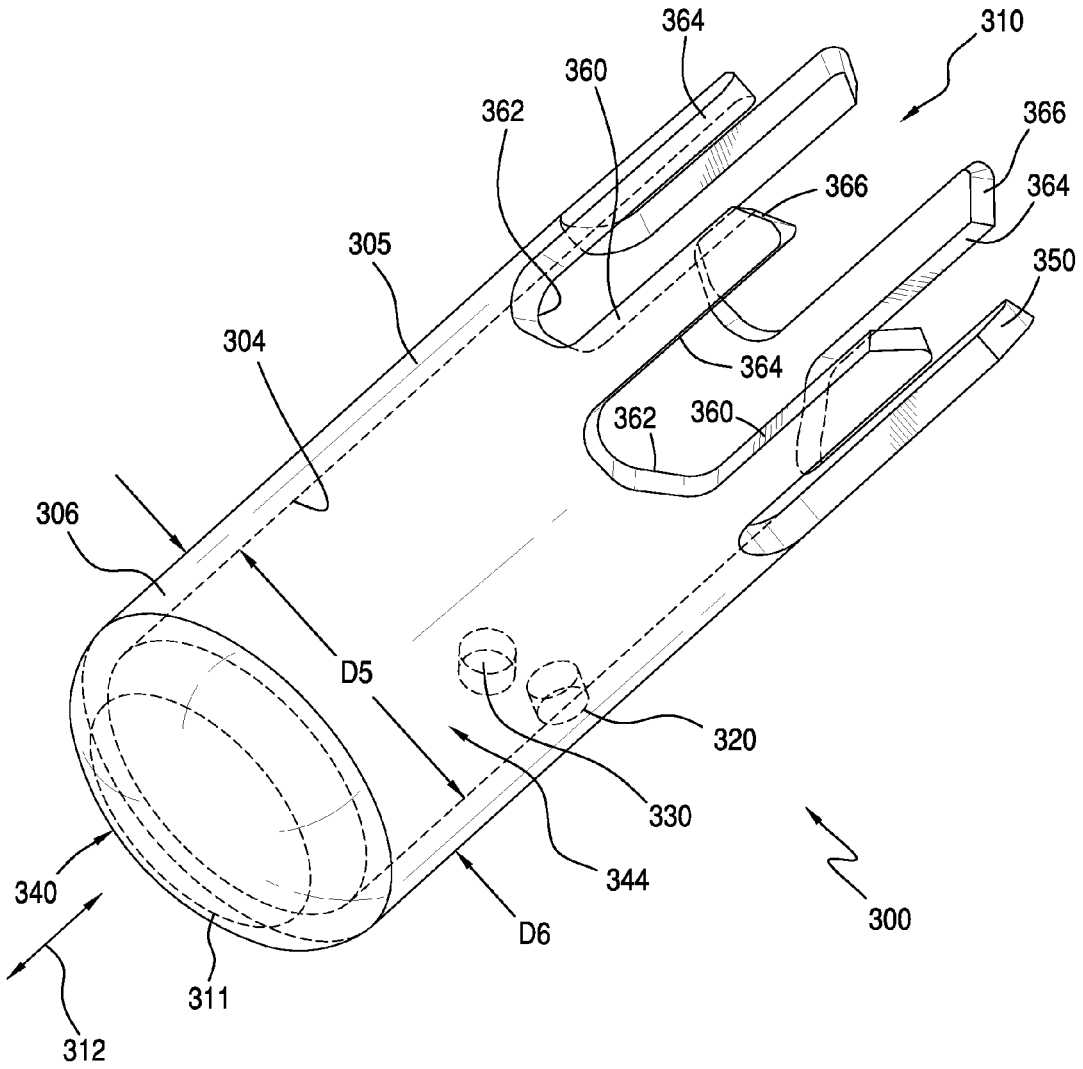
FIG. 2 is a perspective view of a first portion of the housing of the pump of the instant invention.

As shown in FIG. 2, the distal housing portion 300 comprises an elongate cylindrical member extending along a longitudinal axis 312 that has a circumferential wall 305 defined by an inside diameter D5, an inside or inner surface 304, an outside diameter D6, an outside or outer surface 306, an open proximal end 310, and a distal end 311 having a closed end portion 340. A hole or orifice forming an inlet 320 and a hole or orifice forming an outlet 330 are provided through wall 305 of housing portion 300. A repeating distal track 350 extends from the opening at proximal end 310 to approximately midway inside housing portion 300.

Repeating track 350 is formed as a continuous cutout or groove at the inner surface 304 of wall 305. The cutout of track 350 is shaped to be elongate in the longitudinal direction 312, approximately U-shaped where the track ends its extension towards the distal end 311, and selectively angled at the end of distal housing portion 300 at proximal end 310. The distance between the side walls of the track that forms the cutout is greater than the distance of the non-cutout regions sandwiching the elongate portions of the cutout along the inner surface 304 of the circumferential wall 350. The respective curvatures at the U-shaped ends and the angles at the distal ends of track 350 correspond to the respective pitch P1 and pitch P2 of the piston (shown in FIG. 3).

Per shown in FIG. 2, track 350 has a first contour surface 360 that extends substantially in parallel to longitudinal axis 312. A second contour surface 362 continuing from contour surface 360 towards distal end 311 is shown to initially curve gently and then curves more abruptly to meet with a third contour surface 364 that extends substantially in parallel to longitudinal axis 312. A fourth contour surface 366 continuing from surface 312 forms an angle of greater than 90 degrees with third contour surface 364. The angled arc or apex formed at the junction where contour surfaces 364 and 366 meet has contacting surface 366 sloping away from proximal end 310 as it reaches the next first track contour surface 360 in the repeating track where the contour surfaces described above are repeated.

Figure 5:
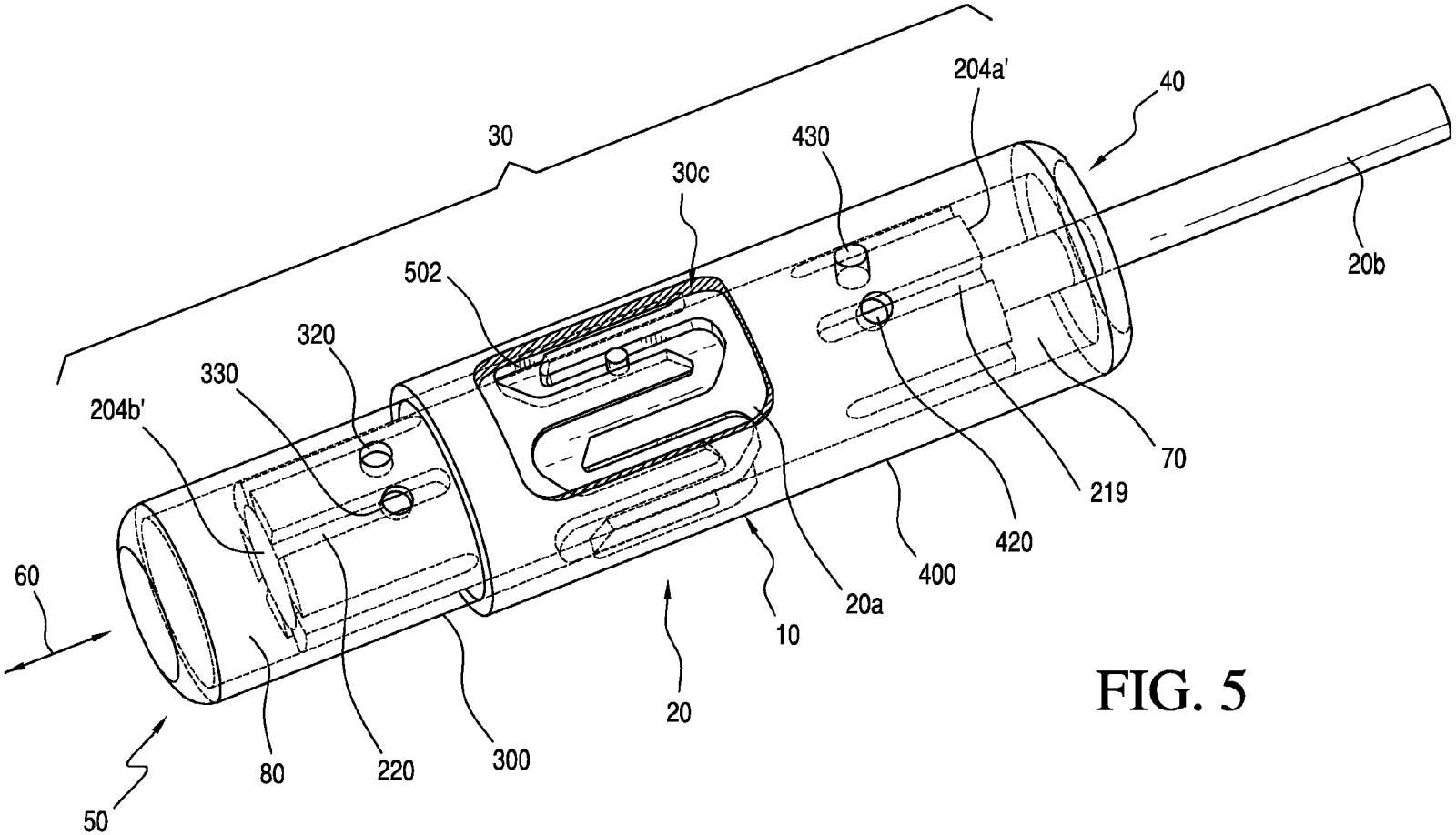
FIG. 5 is a partial perspective view with a window cut out at the housing illustrating an exemplar embodiment of the assembled pump of the instant invention.

The inside diameter D5 of distal housing portion 300 is of a sufficient dimension to enable inner surface 304 to fittingly mate with the outer circumferential surface of the piston, to be described in greater detail below, to sealingly prevent passage of a pressurized fluid from one chamber to another chamber when the housing is constructed to include multiple, for example two chambers. Distal housing portion 300 is considered to form one of these chambers, i.e., a distal chamber 80 (FIG. 5). To better define the chamber, conceivably a partition wall with a center aperture to enable the passage of the piston may be provided or formed within distal housing portion 300 orthogonal to the longitudinal axis 312 to effect a reservoir for fluid storage.

Figure 3:
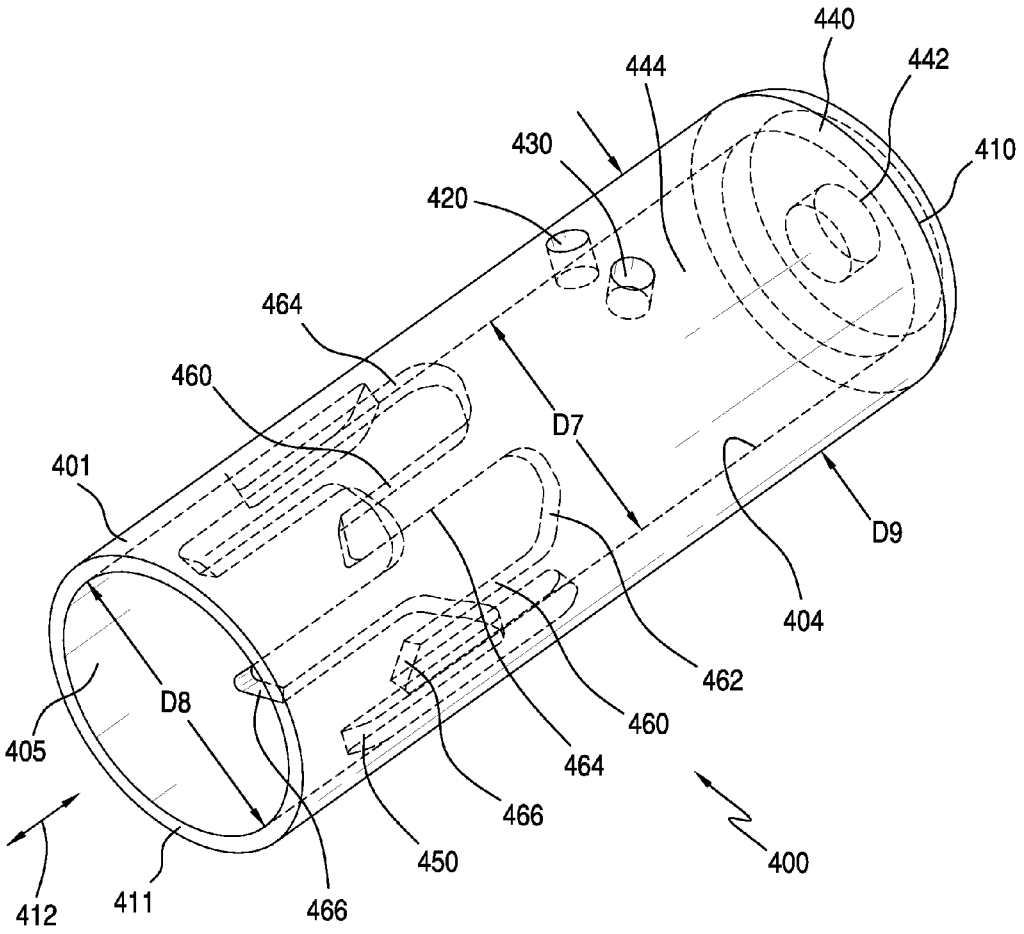
FIG. 3 is a perspective view of a second portion of the housing of the inventive pump.

With reference to FIG. 3, a proximal housing portion 400, the second housing half portion of the inventive housing, is shown to be an elongate cylindrical member having a circumferential wall 401 extending along a longitudinal axis 412 that has a first inside diameter D7 and a second inside diameter D8 defining a first inside or inner surface 404 and a second inside or inner surface 405, respectively. Proximal housing 400 further is defined by an outside surface 406 with an outside diameter D9, a proximal end 410 and a distal end 411. A hole or orifice forming an inlet 420 and a hole or orifice forming an outlet 430 are provided at wall 401. Proximal housing portion 400 is further shown to have a closed end portion 440 at its proximal end 410 that has a bore 442 concentric with longitudinal axis 40 to accept a drive shaft of a piston movably fitted in the housing, as will be discussed in greater detail below. A proximal chamber 70 is defined in proximal housing portion 400. Similar to the discussion above with regard to distal housing 300, a partition wall with a center aperture may be moldedly or otherwise formed orthogonal to longitudinal axis 412 within proximal housing portion 400 to form a fluid storage or reservoir.

Proximal housing portion 400 further has a repeating track 450 extending from its distal end 411 at inner surface 405 approximately midway along the elongate housing towards its closed end portion 440. Repeating track 450 is formed as a continuous cutout at the inner surface 405 of wall 401. The cutout of track 450 is shaped to be elongate along longitudinal direction 412, approximately U-shaped at distal end 411, and selectively angled where the track ends its extension approximately midway along the elongate housing. The distance between the side walls of the track that form the cutout is greater than the distance of the non-cutout regions sandwiching the elongate portions of the cutout along the inner surface 405 of the circumferential wall 401. As with repeating track 350 of distal housing portion 300 shown in FIG. 2, for repeating track 450, the respective curvatures at the U-shaped ends and the angles at the open ends of track 450 correspond to the respective pitch P1 and pitch P2 of the piston (shown in FIG. 5).

As further shown in FIG. 3, repeating track 450 has a first contour surface 460 generally parallel to longitudinal axis 412, a second contour surface 462 initially curving gently and then more abruptly, a third contour surface 464 generally parallel to longitudinal axis 412, and a fourth contour surface 466 that forms an angle of greater than 90 degrees with third contour surface 464 at the junction where contour surfaces 466 and 464 meet, i.e., an arc that slopes away from proximal end 410 as it reaches the next first track contour surface 460 in the repeating track. As should be apparent, the contour surfaces described above are repeated along the track.

As is the case with distal housing portion 300, the first inner surface 404 of proximal housing 400 is of a sufficient dimension to enable inner surface 404 to sealingly and fittingly mate with the outer circumferential surface of the piston to thereby prevent passage of a pressurized fluid from one chamber to another chamber when the housing is constructed to include multiple chambers. Proximal housing portion 400 and distal housing portion 300 may be held in a fixed positional relationship relative to each other by an addition element, including but not limited to, a bracket or an outer sleeve or band. Furthermore, as noted above, proximal housing portion 400 and distal housing portion 300 may in practice be portions of a single unitary housing in which a continuous track in the shape of a cutout or groove formed of the track contour surfaces discussed above is provided along the inside circumferential surface of the unitary housing.

One exemplar method for holding proximal housing portion 400 and distal housing portion 300 fixedly relative to each other along the longitudinal axis is illustrated in FIG. 5 where the tracked portion of proximal housing 400 is shown to be fittingly mated with the tracked portion of proximal housing 300. This is possible because the inside diameter D8 of proximal housing 400 is sufficiently larger than the outside diameter D6 of housing 300 to enable corresponding portions of the housings to matingly fit to each other. Once mated to each other, housings 300 and 400 may be held together by any of a variety of means, including, but not limited to frictional interference fit, adhesive or ultrasonic bonding, or a pressure exerting band or bracket as described above.

In an exemplar embodiment of the instant invention where the assembled housing 30 (from housing portions 300 and 400) is configured to have two compartments (distal chamber 80 and proximal chamber 70 discussed above) where the flow rate of the fluid output from distal outlet 320 (of housing portion 300) is similar to the flow rate of the fluid output from proximal outlet 420 (of housing portion 400), the volume of reservoir space 344 in the portion of housing 30 formed from housing portion 300 is substantially equal to the volume of reservoir space 444 in housing portion 400 that is now a portion of housing 30. In other words, to make up for the volume capacity lost in proximal housing portion 400 due to a drive shaft extending through bore 442, chamber 70 may be larger than chamber 80 at the distal housing portion 300. Alternatively, the linear rate of travel may be adjusted ratio-metrically based on the cross sectional area of the respective piston geometry.

For ease of discussion hereinbelow, the reservoir spaces 344 and 444 may also be referred to as compartments or chambers 344 and 444, respectively. Although described as having substantially the same reservoir volume, as discussed above, it should be noted that there may be instances where the chambers or compartments in the inventive pump may be configured to have different dimensions so that the compartments of the housing are adapted to have different reservoir volumes.

Figure 4:
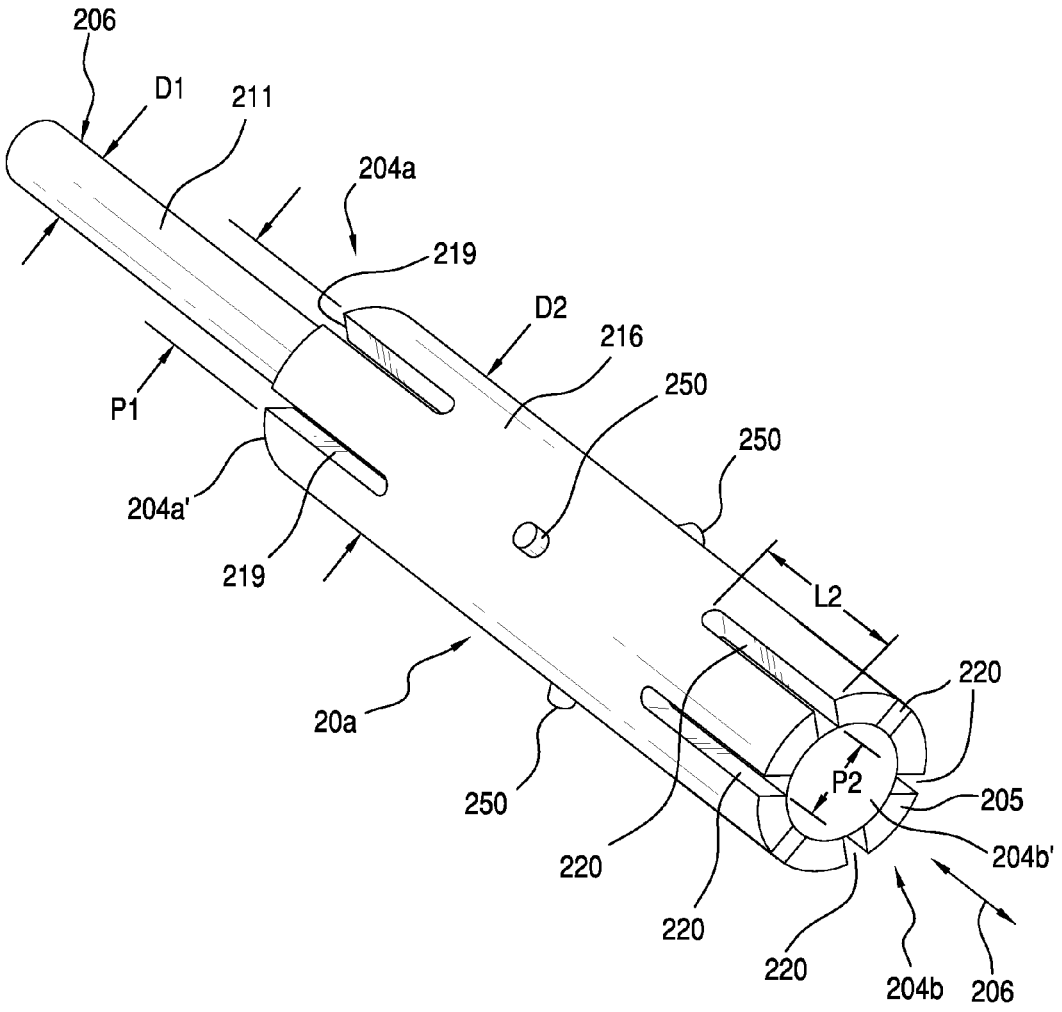
FIG. 4 is a perspective view of the piston of the inventive pump.

The piston assembly of the instant invention is shown in FIG. 4. As illustrated, piston assembly 20 has an elongate piston 20*a* attached to a drive shaft 20*b*, each extending along a longitudinal axis 206. Piston 20*a* has a proximal end 204*a* and a distal end 204*b*, and is made of an elastomeric material or cured rubber. The respective proximal and distal end surfaces 204*a*' and 204*b*' at proximal and distal ends 204*a* and 204*b* are movable along their corresponding chambers or compartments 444 and 344, respectively. In practice, proximal and distal end surfaces 204*a*' and 204*b*' at proximal and distal ends 204*a* and 204*b*, respectively, act as the respective slidably movable walls of those chambers to relatedly adjust the respective volumes or fluid capacities of those chambers. As will be described infra, due to the movement of the piston 20*a* and the associated sliding movement of the end surfaces 204*a*' and 203*b*', when the volume of one of the chambers increases, the volume of the other of the chambers would decrease, and vice versa. Note that if there are partitions formed to wall off or define proximal and distal chambers 444 and 344 within housing 30, those partitions would have central apertures for drive shaft 20*b* to enable the bidirectional movement of the piston 20*a* within the chambers.

With further reference to FIG. 4, piston 20*a* may be an elongate splined cylindrical member having provided at the outer circumferential wall 216 at least one cam, boss or protuberance 250 that extends away from the surface of wall 216. A plurality of bosses or protuberances 250 (at least two shown) are provided at substantially the middle portion of the piston 20*a*. A through bore extends along the cylindrical splined member to accept drive shaft 20*b*. Drive shaft 20*b* is an elongate solid member having a portion that extends into the through bore of piston 20*a* so that its distal end 205 may be flush with the distal end 204*b* of piston 20*a*. The outside diameter of the portion of shaft 20*b* inserted into piston head 20*a* is larger than the diameter of the portion of shaft 20*b* that extends away from piston 20*a*. Piston 20*a* is fixedly held to shaft 20*b* by known conventional means and methods, for example gluing, friction fit or bonding.

At the proximal and distal outer circumferential wall portions of piston 20*a* there are provided multiple longitudinal proximal slots or channels 219 and multiple longitudinal distal slots or channels 220, respectively. Proximal channels 219 each have a given length and a given pitch, for example L1 and P1. Pitch P1 may be any degree value that is an even quotient of a division of 360 degrees. Distal channels 220 each likewise have a given length L2 and a given pitch P2. Pitch P1 is equal to pitch P2, and length L1 is equal to length L2.

In operation within housing 30 as will be described infra, the reciprocation or bidirectional movement distance of piston 20*a* is substantially equal to the length of L1 or L2. At the end of each stroke of piston 20, the piston rotates, relative to housing 30, according to pitch P1 and pitch P2.

With reference to FIG. 5, piston assembly 20 and housing 30 are shown to have been assembled together with piston 20*a* movably fitted into housing 30 along longitudinal axis 60. Housing 30 may be assumed to be either formed from housing half portions 300 and 400 having been fixedly coupled to each other as discussed above, or is a single unitary piece housing formed for example by extrusion, or other known molding techniques. With reference to the discussion above, the assembled pump 10 has a proximal end 40, a distal end 50, a proximal chamber 70, and a distal chamber 80. For the embodiment shown in FIG. 5, it is assumed that the outer circumferential surface at the middle portion of piston 20*a* is slightly smaller than the inner circumferential wall surface of housing 30. And given that piston 20*a* is made of an elastomer or another material having elastomeric and sealing qualities, the body of piston 20*a* acts as a seal to prevent fluid from traversing between the proximal and distal chambers 70 and 80 within housing 30, even though piston 20*a* is adapted to be freely movable longitudinally along and rotatable within housing 30.

For the instant invention, piston 20*a* is driven (for example by the motor shown in and described in FIG. 1) within housing 30 in a reciprocating or bidirectional manner along longitudinal axis 60. As the piston 20*a* is reciprocally driven, it is guidedly moved within housing 30 due to the protuberance(s), cam(s) or boss(es) extending therefrom being mated to the internal track of housing 30. When it is driven reciprocally, piston 20*a* is selectively moved bidirectionally within housing 30 and rotate relative to housing 30.

As shown per the window cutout 30*c* at housing 30 in FIG. 5, repeating distal track 350 at housing portion 300 (FIG. 2) and repeating proximal track 450 at housing portion 400 (FIG. 3) cooperate to form a continuous or non-ending track 502 in the assembled housing 30. The respective grooves of repeating tracks 350 and 450 have the same dimensions so that track 502 formed by the coupled together tracks 350 and 450 has a uniform track groove throughout that is sized to enable protuberance(s) 250 at piston 20*a* to fittingly mate therein and freely movable therealong in conjunction with the movement of piston 20*a*. Note that window cutout 30*c* is for illustration purpose only and in actuality is not present in the product manufactured in accordance with the instant disclosure.

In operation, focusing on only the one protuberance at piston 20*a*, note that protuberance 250 has a first position in track 502 formed within housing 30. When protuberance 250 is in the position per shown in track 502, distal inlet 330 is in alignment with distal channel 220 so that a fluid communication path is established therebetween. At the same time, distal outlet 320 is sealed off by outer surface 216 of piston 20*a*. Also, proximal outlet 420 is in alignment with proximal channel 219 to establish a fluid communication path therebetween, and proximal inlet 430 is sealed off by piston 20*a*, i.e., the outer surface 216 thereof. As discussed above, even though one protuberance is discussed above, in practice there may be at least one more protuberance, cam or boss formed possibly at a side of the piston opposite to the discussed protuberance, so that a more balanced movement of the piston relative to the housing may be effected.

The movement of piston 20*a* relative to housing 30 to selectively control the conveyance of fluid from a fluid store to a patient is discussed herein with reference to FIGS. 6A to 6I, where the movements of the protuberance relative to housing 30 along the continuous track 502 are shown via window cutout 30*c*. As will be discussed below, the combined rotational and sliding movements of piston 22*a* in housing 30 selectively and synchronously control the opening and closing of the respective inlets and outlets at the different chambers in housing 30.

Figure 6A:
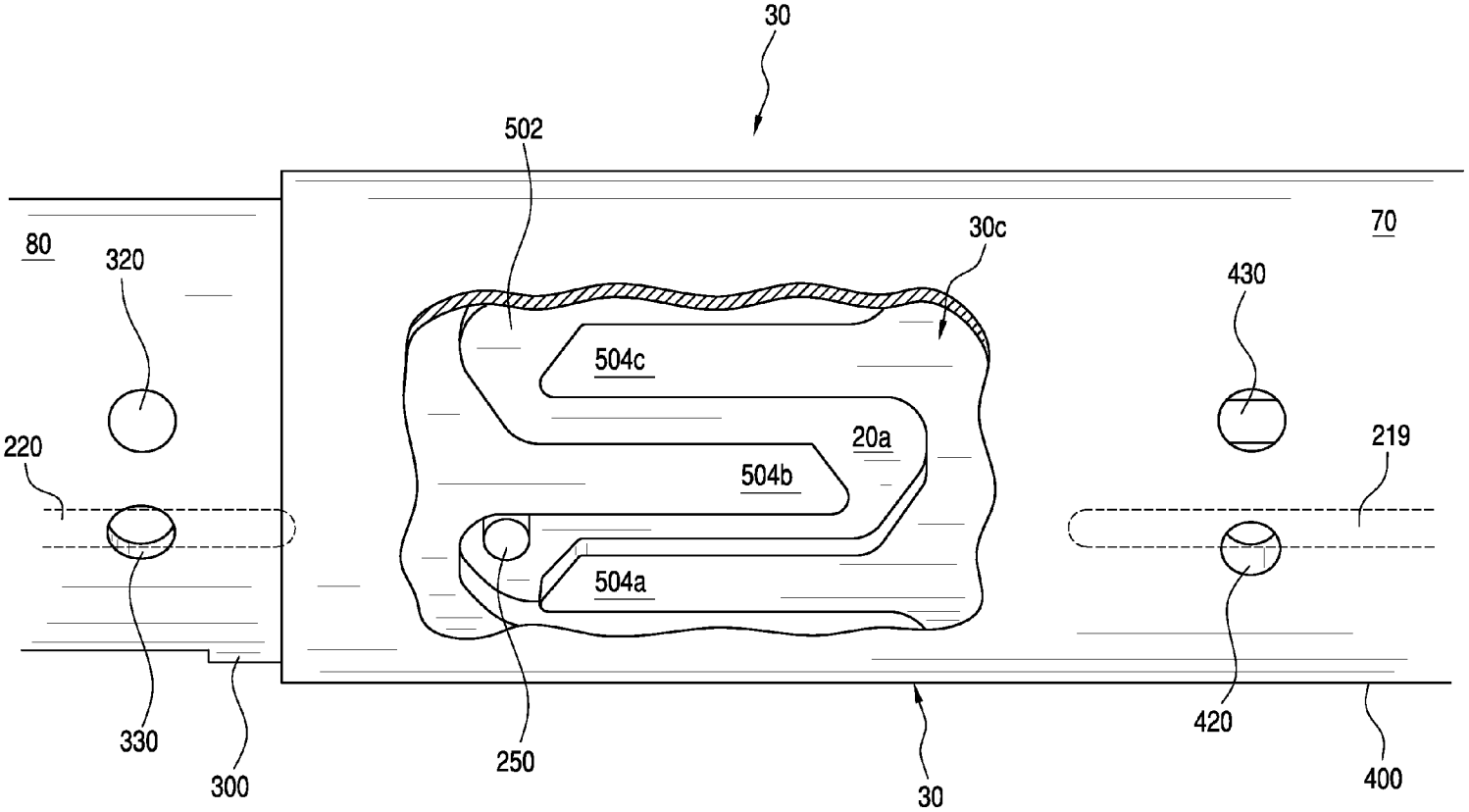
FIG. 6A is an enlarged view of the center portion of the exemplar pump of FIG. 5 with the being illustrated portion of the housing removed to illustrate the movement of the piston, as represented by the protuberance or boss attached thereto in a first position, relative to the guiding track internal to the housing.

With reference to FIG. 6A and as illustrated via window cutout 30*c*, protuberance 250 is guided by track 502 longitudinally as piston 20*a* is at the beginning of a stroke. As shown, distal inlet 330 at distal chamber 80 is in alignment with a corresponding one of the distal slots or channels 220 (in dotted line) of piston 20*a*, and proximal outlet 420 at proximal chamber 70 is in alignment with one of the proximal slots or channels 219 (in dotted line) of piston 20*a*. For ease of discussion, the three longitudinally extending legs shown in window cutout 30*c* that guide the movement of protuberance 250 along the non-ending track 502 are labeled 504*a*, 504*b* and 504*c*. In FIG. 6A, protuberance 250 is shown to be at a distal end of track 502 in contact with the base of leg 504*b* and facing the foot end of leg 504*a*.

Figure 6B:
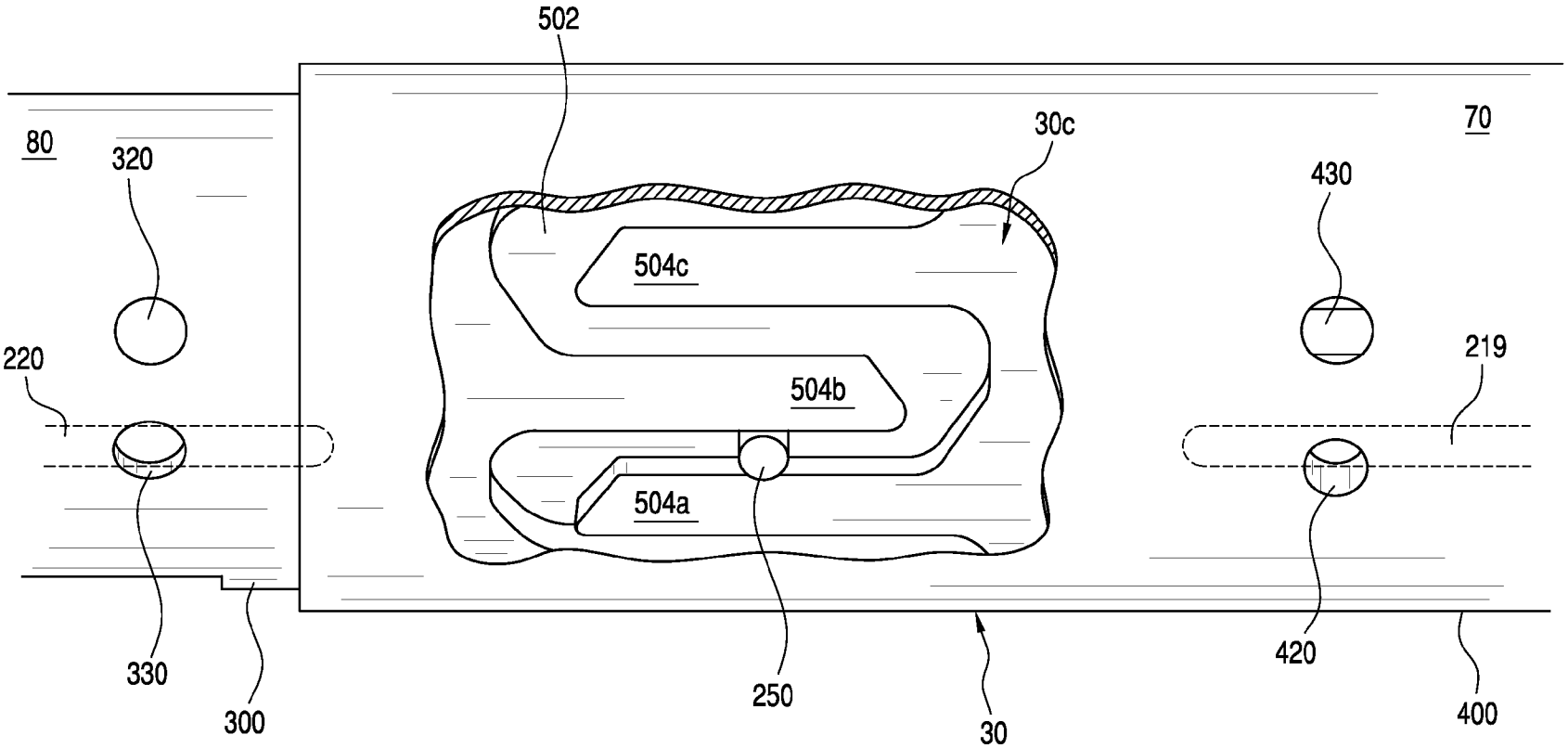
FIG. 6B shows the protuberance in a second position along the guiding track internal to the inventive pump housing.

FIG. 6B shows protuberance 250 to have moved to a substantially halfway position along a longitudinal pathway of track 502 between legs 504*a* and 504*b*. The movement of protuberance 250 results from piston 20*a* having been driven to a second position relative to housing 30. At this position, the storage capacity of proximal chamber 70 in housing 30 is decreased to thereby cause an increase of the pressure within proximal chamber 70. As a result, the fluid stored in proximal chamber 70 is forced to flow into proximal channel 219 and from there output from proximal outlet 420.

Further, as piston 20*a* is advanced to the second position, piston 20*a* retracts away from distal housing portion 300, thereby increasing the storage volume or capacity of distal chamber 80. And as the pressure within distal chamber 80 decreases, a negative pressure is built up in distal chamber 80 to draw fluid into distal chamber 80 via distal inlet 330 and distal channel 220.

Figure 6C:
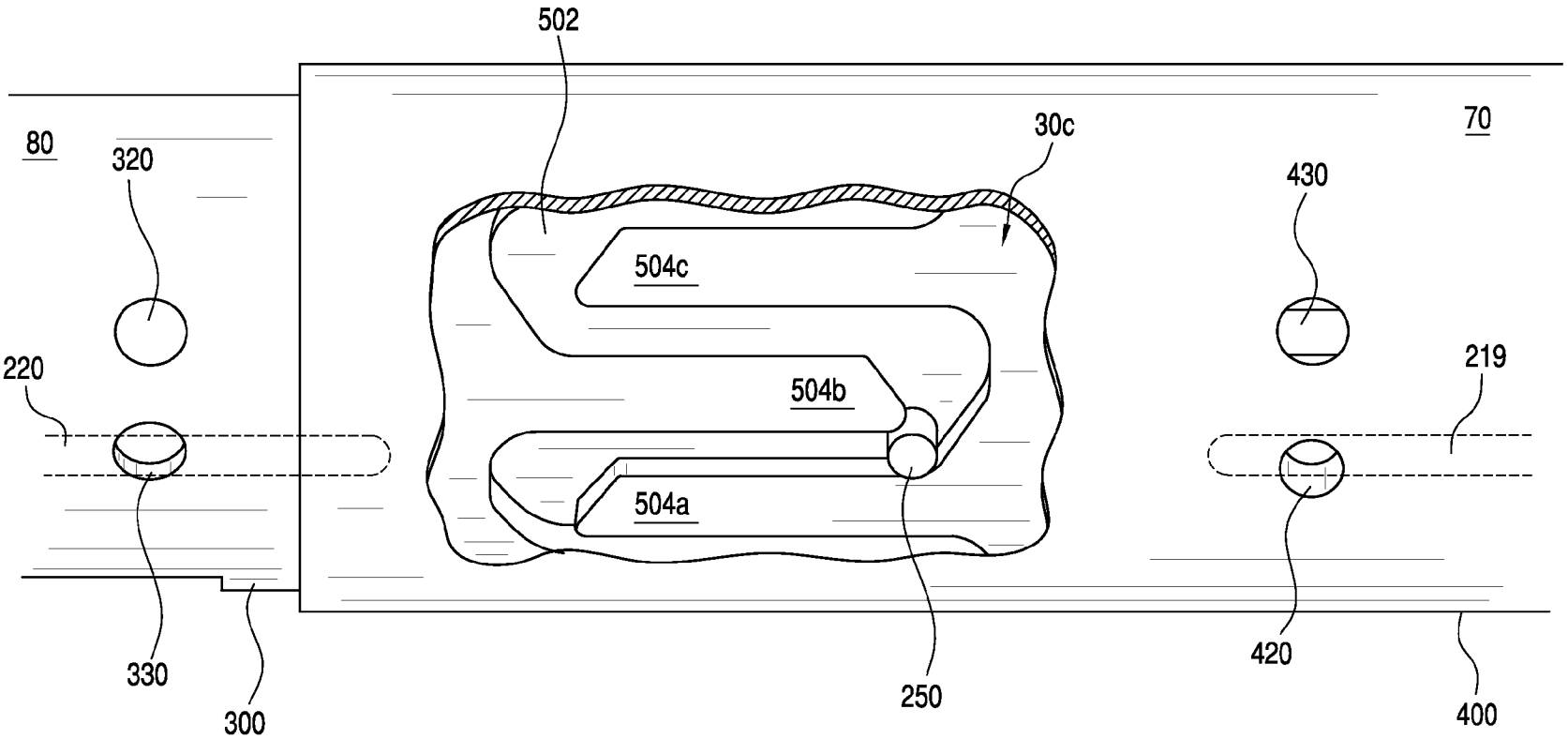
FIG. 6C shows the protuberance in a third position along the guiding track internal to the inventive pump housing.

In FIG. 6C, piston 20*a* has advanced to a third position along track 502 where protuberance 250 is shown to be at the base of leg 504*a* and the apex of the foot end of leg 504*b*. With piston 20*a* at this third position, there is a further decrease in the dimension or volume of proximal chamber 70, i.e., the storage capacity of proximal chamber 80 decreases, thereby forcing fluid stored therein to flow into proximal channel 219 and from there output from proximal outlet 420.

Also, with piston 20*a* at the third position per shown in FIG. 6C, the storage capacity of distal chamber 80 further increases, so that additional fluid is drawn into distal inlet 330 to flow along distal channel 220 into distal chamber 80.

Figure 6D:
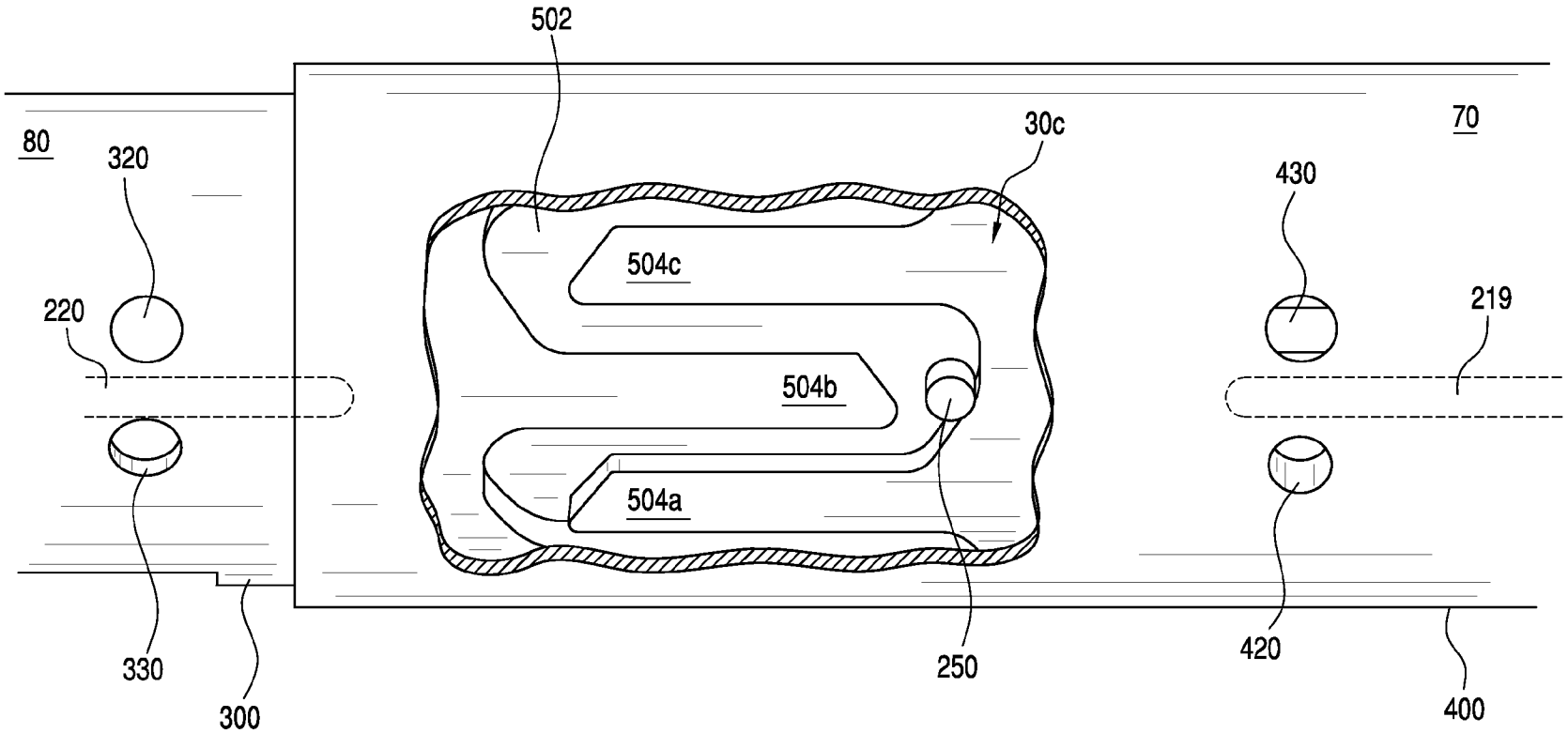
FIG. 6D shows the protuberance in a fourth position along the guiding track internal to the inventive pump housing.

In FIG. 6D, piston 20*a* has advanced to a fourth position along track 502 where protuberance 250 is shown to being guidedly moved along a generally U-shaped edge portion of track 502 that connects legs 504*a* and 504*c*. Guided by track 502 at this position, protuberance 250 causes piston 20*a* to rotate relative to housing 30 to thereby move distal channel 220 at piston 20*a* out of alignment with distal inlet 330. As a result, the fluid communication path between distal channel 220 and distal inlet 330 is disrupted, with distal inlet 330 and distal outlet 320 both being sealed by the outer circumferential surface of piston 20*a*. At the same time, the movement of piston 20*a* relative to housing portion 400 also causes proximal outlet 420 to move out of alignment with proximal channel 219 to terminate the fluid path therebetween. At the same time, both proximal outlet 420 and proximal inlet 430 are sealed by the outer circumferential surface of piston 20*a*.

Figure 6E:
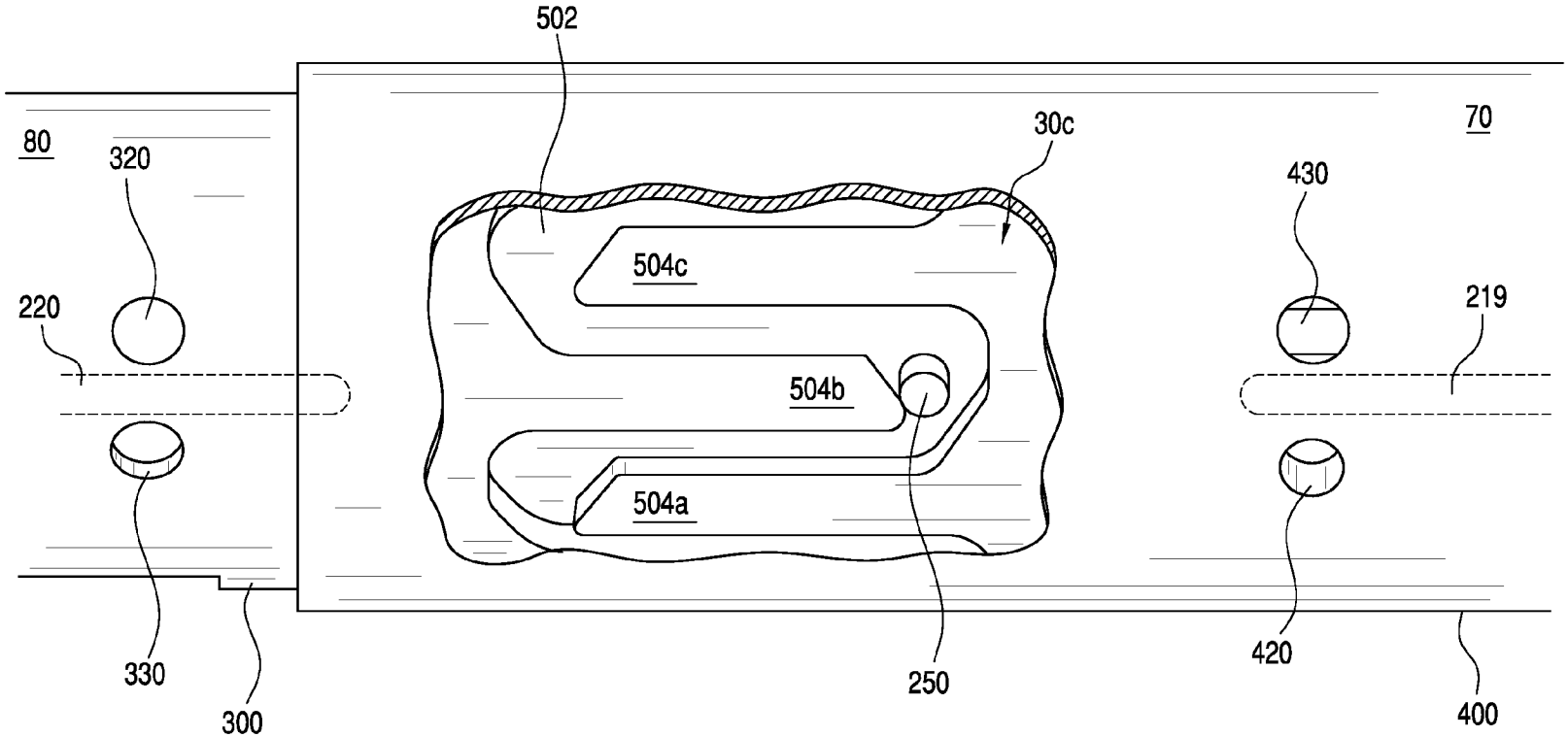
FIG. 6E shows the protuberance in a fifth position along the guiding track internal to the inventive pump housing.

In FIG. 6E, piston 20*a* has moved, in a retracted or retarded manner, in the opposite direction to a fifth position along track 502, per shown by protuberance 250 having moved away from the generally U-shaped edge portion connecting legs 504*a* and 504*c*, and is in contact with the foot end of leg 504*b*. At this position, distal inlet 330 and distal outlet 320 are sealed or closed by a non-channeled surface portion of piston 20*a* and therefore neither is in fluid communication with distal channel 220. Likewise, proximal inlet 430 and proximal outlet 420 are sealed or closed by another non-channeled portion of piston 20*a* and each are not in fluid communication with proximal channel 219.

If piston 20*a* is further driven at this position, protuberance 250 is moved to abut with the fourth contour surface 466 at proximal housing portion 400 (FIG. 3), which causes protuberance 250 to be redirected to a return path along track 502, i.e., changes the direction of its movement.

Figure 6F:
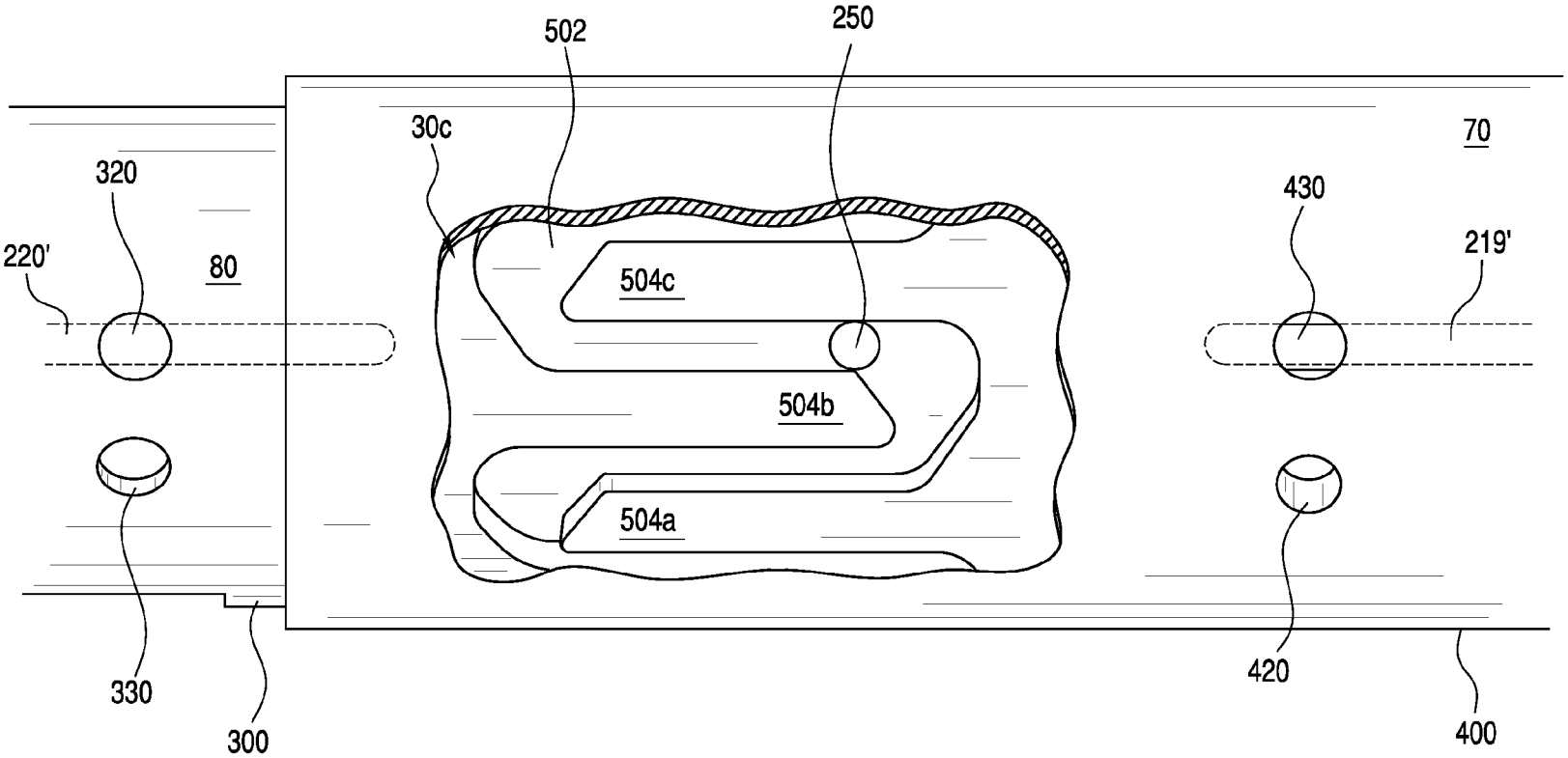
FIG. 6F shows the protuberance in a sixth position along the guiding track internal to the inventive pump housing.

In FIG. 6F, piston 20*a* has retracted or retarded to a sixth position along track 502. This is represented by protuberance 250 being shown to be at the mouth of the longitudinal pathway sandwiched by legs 504*b* and 504*c*. At this position, piston 20*a* has been rotated to align another of its proximal channels 219' with proximal inlet 430 and a second of its distal channels 220' with distal outlet 320. And as piston 20*a* is driven distally along distal chamber 80, its distal end surface 204*b*' would act as a movable end wall of chamber 80 to thereby cause a decrease in the storage capacity of distal chamber 80. As a result, pressure within distal chamber 80 increases, thereby forcing the fluid stored therein to flow into distal channel 220 and from there output from distal outlet 320.

The positioning of piston 20*a* to the retarded sixth position along track 502 also causes the proximal end surface 204*a*' of piston 20*a* to move to a further distal position. As end surface 204*a*' forms a movable wall of proximal chamber 70, its distal movement thus causes an increase in the storage capacity of proximal chamber 70 at proximal housing portion 400. This in turn establishes a negative pressure within proximal chamber 80 to thereby draw fluid into proximal inlet 430 and convey or flow along proximal slot or channel 219' into proximal chamber 70.

Figure 6G:
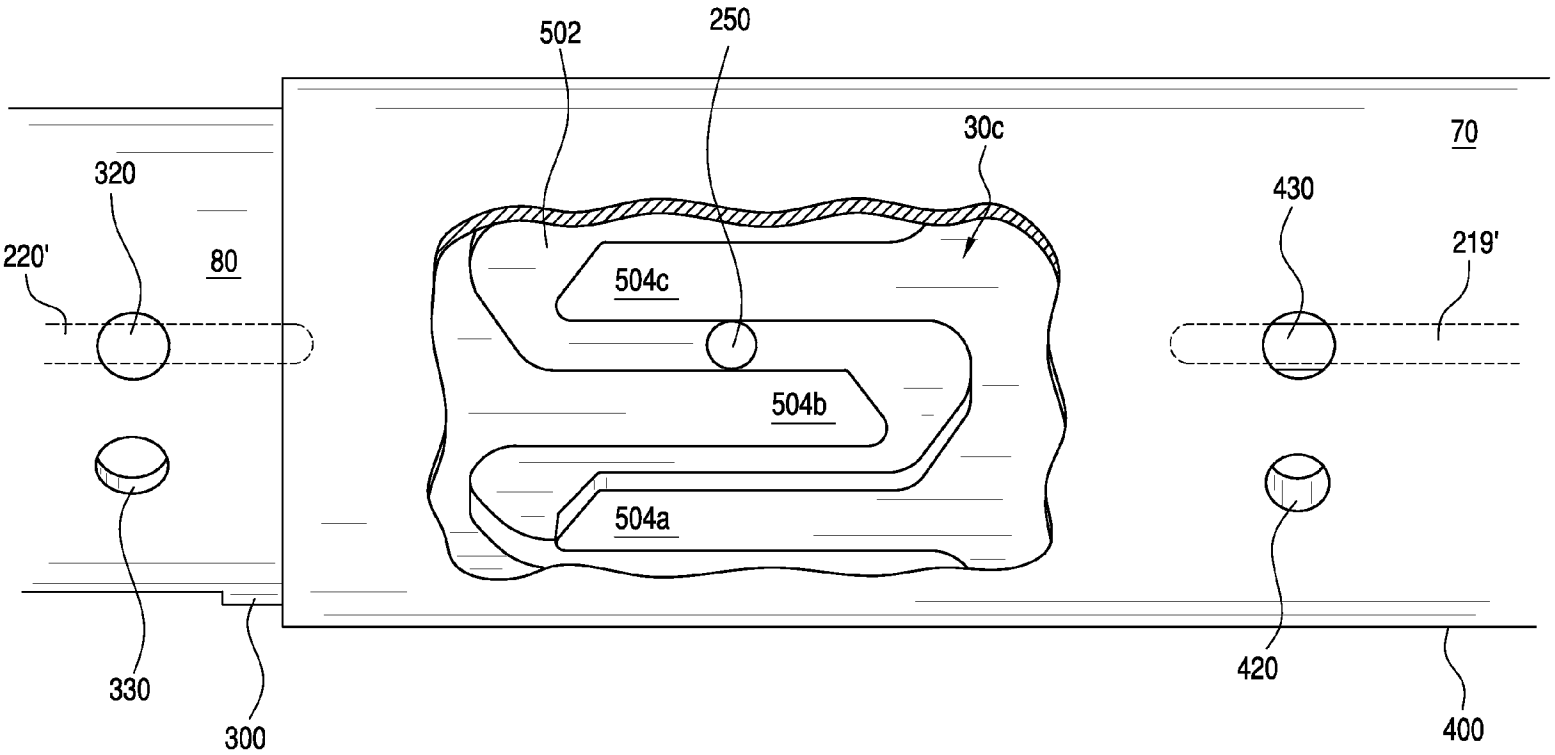
FIG. 6G shows the protuberance in a seventh position along the guiding track internal to the inventive pump housing.

Per shown in FIG. 6G, piston 20*a* is driven or retarded to a seventh position along track 502. This is shown by protuberance 250 being positioned substantially midway along the longitudinal pathway between legs 504*b* and 504*c*. At his position, the storage capacity of distal chamber 80 at distal housing portion 300 decreases due to the movement of distal end surface 204*b*' of piston 20*a*. When distal chamber 80 is thus compressed, the pressure within the chamber increases, thereby forcing the fluid stored therein to flow into distal slot or channel 220' for output from distal outlet 320.

At the same time, at this seventh position, as piston 20*a* is driven distally, the storage capacity of proximal chamber 70 increases due to the movement of proximal end surface 204*a*' along proximal housing 400. As a result, a negative pressure is established in proximal chamber 70, resulting in fluid being drawn into proximal chamber 70 by way of the fluid path established by proximal channel 219' and proximal inlet 430.

Figure 6H:
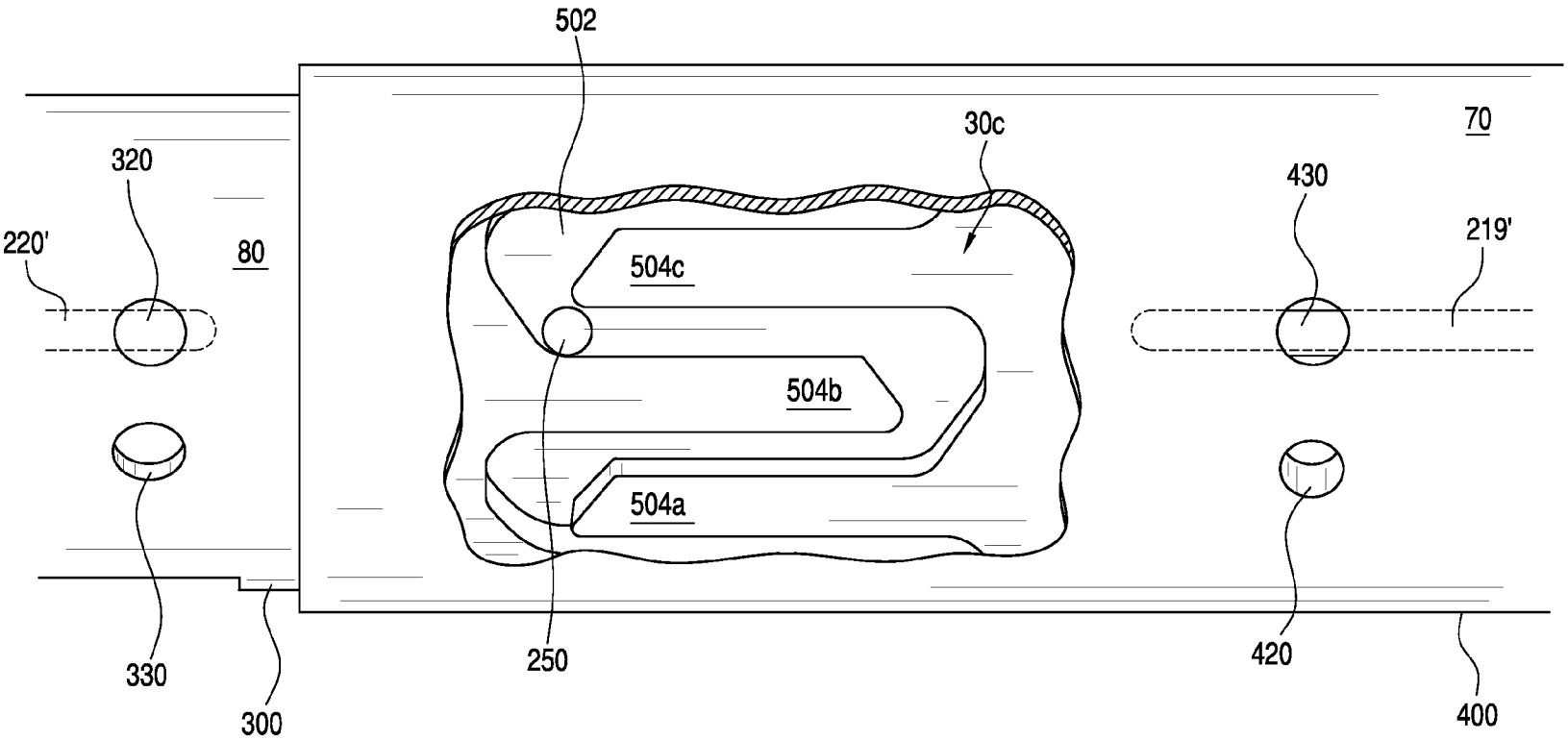
FIG. 6H shows the protuberance in an eighth position along the guiding track internal to the inventive pump housing.

In FIG. 6H, piston 20*a* has moved or retarded to an eighth position along track 502. This is represented by the positioning of protuberance 250 at the distal end of the pathway between legs 504*b* and 504*c*, in particular at the base of leg 504*b* and the foot end of leg 504*c*. At this position, protuberance 250 is guided by track 502 to begin its rotational movement around the generally U-shaped portion of track 502 that begins from the base of leg 504*b* and extends just past leg 504*c*. At this position, piston 20*a* begins to rotate at a given angle relative to housing 30.

As the rotation of piston 20*a* continues, proximal inlet 430 and proximal channel 219' are moved out of alignment with each other in proximal housing portion 400. As a result, the fluid communication path between proximal inlet 430 and proximal channel 219' is blocked off. At the same time, the fluid communication path between distal outlet 320 and distal channel 220' at distal housing portion 300 is also blocked.

Figure 6I:
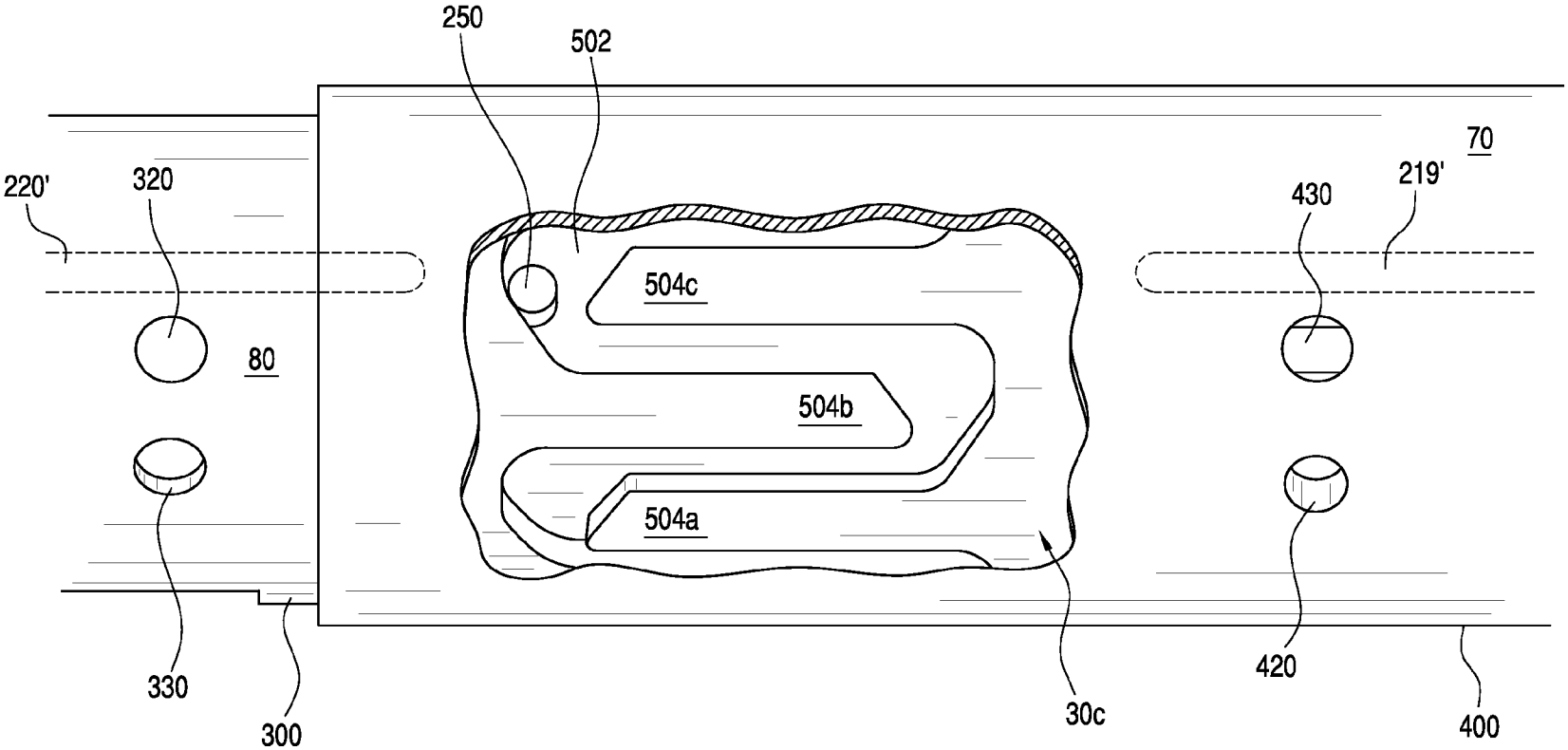
FIG. 6I shows the protuberance in a ninth position along the guiding track internal to the inventive pump housing.

FIG. 6I shows the corresponding positional relationships of the proximate inlet 430 and distal outlet 320 with proximal channel 219' and distal channel 220', respectively, at substantially the end of the exemplar rotational movement of piston 20*a*. As shown, at this eighth position along track 502, protuberance 250 is positioned at the valley of the substantially U-shaped portion of track 502 that faces the foot end of leg 504*c*. At this position, proximate inlet 430 and distal outlet 320 are no longer in alignment with their respective proximal channel 219' and distal channel 220'. Instead, distal outlet 320 and proximal inlet 430, as well as distal inlet 330 and proximal outlet 420, are sealed by respective non-slotted or non-channeled elastomeric portions of piston 20*a*, so as to be closed or sealed off from the outside environment.

If piston 20*a* were to be further driven, protuberance 250 is moved to abut with the fourth contour surface 366 at distal housing portion 300 (FIG. 2), i.e., the portion of the substantially U-shaped track where the track begins to turn along its left upright (as viewed from FIG. 6I). This would cause protuberance 250 to be directed to a longitudinal pathway between leg 503*c* and an unseen adjacent leg in the proximal direction so that the combined rotational and longitudinal movements of piston 20*a* as described in FIGS. 6A-6I are repeated. Accordingly, there is a substantially continuous conveyance of fluid by the pump device of the instant invention, due to fluid being input into one chamber as fluid is being output from other chamber. Thus, for each cycle it is driven, piston 502 is guided by the non-ending track 502 to slidably move reciprocally within housing 30 and to rotate at the end of each advance stroke and at the end of each retard stroke to synchronously and selectively control the flow of fluid between the fluid store and the patient, by means of a fluid receiver which may include catheters and needles.

It should be understood that although the embodiment illustrated in FIG. 1 shows a single fluid supply reservoir in fluid communication with both the distal and proximal inlets of the pump, separate fluid supplies may in practice be separately provided to supply fluid to the distal and proximal inlets at the pump housing. Similarly, the distal outlet and the proximal outlet at the pump housing may be fluidly connected to the same output for delivery or may be fluidly connected to separate outputs so that the output fluid may be delivered to different locations.

It should further be appreciated that the fluid as described in this application encompasses liquids including different medicaments and medication, gases and amorphous materials that are adapted to be delivered by the pump disclosed above.

The invention disclosed herein is subject to various modifications and changes in detail. Thus, the matters disclosed in this specification and shown in the drawings should be interpreted as illustrative only and not in a limiting sense. Accordingly, it is intended that the invention be limited only by the spirit and scope of the hereto attached claims.

The invention claimed is:

1. A pump, comprising:

a housing having an inlet, an outlet, and at least one internal track;

an elongate piston movably fitted to the housing, the piston having at least one protuberance and at least one longitudinal channel formed along a predetermined length at its outer surface, the protuberance being movably mated to the track so that the piston is movable within the housing guided by the movement of the protuberance along the track;

wherein the track is configured to have a path that guides the piston to selectively move longitudinally and rotate inside the housing in a reciprocal fashion as the piston is bidirectionally driven along the housing so that when the piston is driven in a first direction, the inlet is in alignment with the one channel to enable a fluid to be input into the housing and when the piston is driven in a second direction, the outlet is in alignment with the one channel to enable the fluid to be output from the housing.

2. The pump of claim 1, wherein the piston is movable to a selected position whereby the inlet and outlet are both not in alignment with the channel.

3. The pump of claim 1, wherein the housing comprises two half portions mountedly coupled to each other and wherein the track is formed by respective half tracks preformed in the inside circumferential walls of the half portions being joined to each other when the half portions are coupled to each other.

4. The pump of claim 1, wherein the housing is a single unitary housing in which the track is formed as a groove along the inside circumferential surface of the housing.

5. The pump of claim 1, wherein the fluid is a medicament.

6. The pump of claim 1, wherein the housing comprises an elongate cylindrical member having an inside circumferential surface whereat the track is formed as a non-ending track; and wherein the piston rotates in the same direction relative to the housing when cyclically driven and guided by the track to rotate.

7. The pump of claim 1, wherein the housing comprises two chambers and the piston comprises two end surfaces each adapted to slidably move in a corresponding one of the chambers;

wherein when the piston is driven in one position relative to the housing, fluid is input to one of the chambers and output from other of the chambers; and wherein when the piston is driven to an other position relative to the housing, fluid is output from the one chamber and input to the other chamber.

8. The pump of claim 1, wherein the piston comprises a plurality of longitudinal channels along its outer circumferential surface adapted to convey fluid selectively between the interior of the housing and the inlets and outlets, the channels each adapted to be rotated into alignment with the inlet and outlet so that a fluid communication path is selectively established between each of the channels and either the inlet or the outlet;

wherein the channels each are positionable relative to the inlet and outlet by the rotational movement of the piston guided by the track as the piston is being driven to respective advance and retard positions so that the plurality of channels sequentially input and output the fluid into and out of the housing as the piston is driven reciprocally inside the housing.

9. A pump, comprising:

an elongate housing having an inner circumferential surface, the housing partitioned into one and other chambers each having an inlet and an outlet, a track having a given configuration formed at the inner circumferential surface;

a piston movably fitted in the housing, the piston having one and other end surfaces movable along the one and other chambers, respectively, the piston having an outer circumferential surface, at least one protuberance extending from the outer circumferential surface of the piston, the piston adapted to be driven bi-directionally within the housing;

wherein the protuberance is movably mated to the track so that the movement of the piston within the housing is guided by the configuration of the track; and wherein when the piston is driven to a first position, the outlet at the one chamber and the inlet at the other chamber are open and the inlet at the one chamber and the outlet at the other chamber are closed so that fluid is input to the one chamber and fluid, if any, previously stored in the other chamber is output therefrom.

10. The pump of claim 9, wherein the piston is further drivable to a second position whereat the inlets and outlets at the one and other chambers are closed.

11. The pump of claim 9, wherein the piston comprises longitudinal channels along its outer circumferential surface adapted to convey fluid between the chambers and their respective inlets and outlets, the channels each adapted to be rotated into alignment with its corresponding inlet and outlet so that a fluid communication path is established between the each channel and its corresponding inlet and outlet, the channels are positionable relative to the inlets and outlets by the rotational movement of the piston guided by the track as the piston is driven to respective end positions.

12. The pump of claim 9, wherein the housing is formed by two half portions fixedly coupled to each other, each of the half portions having an open end and a closed end, the track is formed by the joining of cutouts at the inner circumferential surface at each of the half portions, each of the half portions providing the space for one of the one and other chambers, one of the half portions having a bore at its closed end to enable the passage of a shaft that connects the piston to a driving means.

13. The pump of claim 9, wherein the track is configured so that the piston, when driven, is guided by the track to selectively move longitudinally along and rotatable relative to the housing.

14. A method of conveying a fluid to and from a housing having at least one inlet and one outlet, comprising the steps of:

(a) providing a piston having at least one protuberance and at least one longitudinal channel at its outer surface;

(b) providing a track of a given configuration within the housing;

(c) movably fitting the piston in the housing with the protuberance movably mated to the track; and (d) driving the piston within the housing, the movement of the piston guided by the movement of the protuberance along the track so that the piston is driven both longitudinally and rotationally within the housing;

wherein when the piston is driven in one direction, the piston is rotated to align the channel with the inlet to establish an input fluid communication path between the interior of the housing and a fluid reservoir; and wherein when the piston is driven in a second direction, the piston is rotated to align the channel with the outlet to establish an output fluid communication path between the interior of the housing and a fluid receiving device.

15. The method of claim 14, wherein step (d) comprises driving the piston reciprocally, the method further comprising the step of:

further driving the piston to a position where the channel is not in alignment with the inlet and the outlet.

16. The method of claim 14, further comprising the steps of:

establishing two chambers each having its inlet and outlet in the housing;

establishing the two ends of the piston as respective surfaces movable to change the volume of the chambers so that each reciprocating movement of the piston that opens an inlet and closes the outlet at one chamber also open the outlet and close the inlet at the other chamber.

17. The method of claim 14, further comprising the step of:

forming the housing by fixedly coupling respective open ends of two housing half portions together;

wherein each housing half portion has formed at its inner circumferential surface respective cutouts that when joined together form the track when the housing half portions are coupled together.

18. Apparatus, comprising:

a piston having an outer circumferential surface;

a shaft attached to the piston at one end and connected to a motor means at its other end so that the piston is adapted to be driven bidirectionally by the motor means;

at least one protuberance extending from the outer surface of the piston;

at least one longitudinal channel provided on the outer surface of the piston;

a housing having at least one inlet, at least one outlet and a track of a given configuration formed at an inner circumferential surface thereof;

wherein the piston is slidably fitted inside the housing so as to be movable therealong, the protuberance of the piston movably mated to the track to guide the movement of the piston within the housing;

wherein the piston is adapted to be driven by the motor means to cyclically move within the housing between an advance stroke and a retard stroke;

wherein for each cycle it is driven, the piston is guided by the track to slidably move reciprocally within the housing and to rotate at the end of each advance stroke and at the end of each retard stroke; and wherein the at least on longitudinal channel is separately moved into alignment with the inlet and outlet to establish respective fluid communication paths into and out of the housing.

19. Apparatus of claim 18, wherein, the at least one longitudinal channel includes a plurality of longitudinal channels formed along selected portions at the exterior circumferential surface of the piston;

wherein the channels establish respective fluid communication paths between the interior of the housing and the inlet and the outlet so that fluid is selectively input into and output from the interior of the housing as each of the plurality of channels comes into alignment with the inlet and the outlet, respectively, during each cycle of movement of the piston.

20. Apparatus of claim 18, wherein the housing is formed by the fixedly coupling of two half housing portions, and wherein the track is formed by the joining of respective track portions preformed in the half housing portions;

wherein each of the half housing portions forms a chamber within the interior of the housing, the at least one inlet and at least one outlet including an inlet and an outlet on each of the half housing portions;

wherein the piston comprises opposing surfaces each movable within a corresponding chamber of the housing so that during each cycle the piston is driven, the respective inlets and outlets at the chambers are selectively and synchronously open and close to convey fluid between a fluid store and a fluid receiving device.

* * * * *